US012369735B2

(12) United States Patent
Ha

(10) Patent No.: US 12,369,735 B2
(45) Date of Patent: Jul. 29, 2025

(54) CLAMP-TYPE CLOTHES HANGER

(71) Applicant: Chong Kyu Ha, Seoul (KR)

(72) Inventor: Chong Kyu Ha, Seoul (KR)

( * ) Notice: Subject to any disclaimer, the term of this patent is extended or adjusted under 35 U.S.C. 154(b) by 0 days.

(21) Appl. No.: 18/289,224

(22) PCT Filed: May 2, 2022

(86) PCT No.: PCT/KR2022/006265

§ 371 (c)(1),
(2) Date: Nov. 2, 2023

(87) PCT Pub. No.: WO2022/235037

PCT Pub. Date: Nov. 10, 2022

(65) Prior Publication Data

US 2024/0251979 A1 Aug. 1, 2024

(30) Foreign Application Priority Data

May 4, 2021 (KR) ..... 10-2021-0057904

(51) Int. Cl.
*A47G 25/06* (2006.01)

(52) U.S. Cl.
CPC ..... *A47G 25/0607* (2013.01)

(58) Field of Classification Search
CPC ..... A47G 25/0607
See application file for complete search history.

(56) References Cited

U.S. PATENT DOCUMENTS 2,605,906 A * 8/1952 Pontius ..... A47G 25/08 D6/323
3,504,878 A * 4/1970 Dressler ..... A47G 25/0607 248/467
4,058,222 A * 11/1977 Singer ..... A47G 25/18 211/49.1
4,956,898 A * 9/1990 Miyamura ..... A44B 19/36 24/20 LS
5,504,978 A * 4/1996 Meyer, III ..... F16L 33/08 24/274 R
5,876,000 A * 3/1999 Ismert ..... F16L 3/221 248/65
6,029,869 A 2/2000 Rice
7,520,476 B2 * 4/2009 Caveney ..... H02G 3/0456 248/59
9,435,476 B2 * 9/2016 Vachon ..... A01G 23/14
9,539,949 B2 * 1/2017 Nuako ..... B60R 7/043
9,586,529 B1 * 3/2017 Sanchez ..... B60R 7/10
10,174,892 B2 * 1/2019 Freeman ..... F21V 33/0056
2005/0284899 A1 12/2005 Fleming et al.

FOREIGN PATENT DOCUMENTS

KR 20-0348222 Y1 4/2004
KR 20-0417712 Y1 6/2006
KR 20-2010-0005313 U 5/2010

OTHER PUBLICATIONS

International Search Report for PCT/KR2022/006265 mailed Aug. 11, 2022 from Korean Intellectual Property Office.

* cited by examiner

*Primary Examiner* — Anita M King
(74) *Attorney, Agent, or Firm* — Revolution IP, PLLC

(57) ABSTRACT

A clamp-type clothes hanger, includes: a main body (100) including a hook (110) on which the clothes are hung; and a clamp (200) which is provided on the main body (100), is fastened to surround a hanger rod (10) provided away from a wall surface, and may fit various diameters of the hanger rod (10).

5 Claims, 7 Drawing Sheets

【Figure 1】
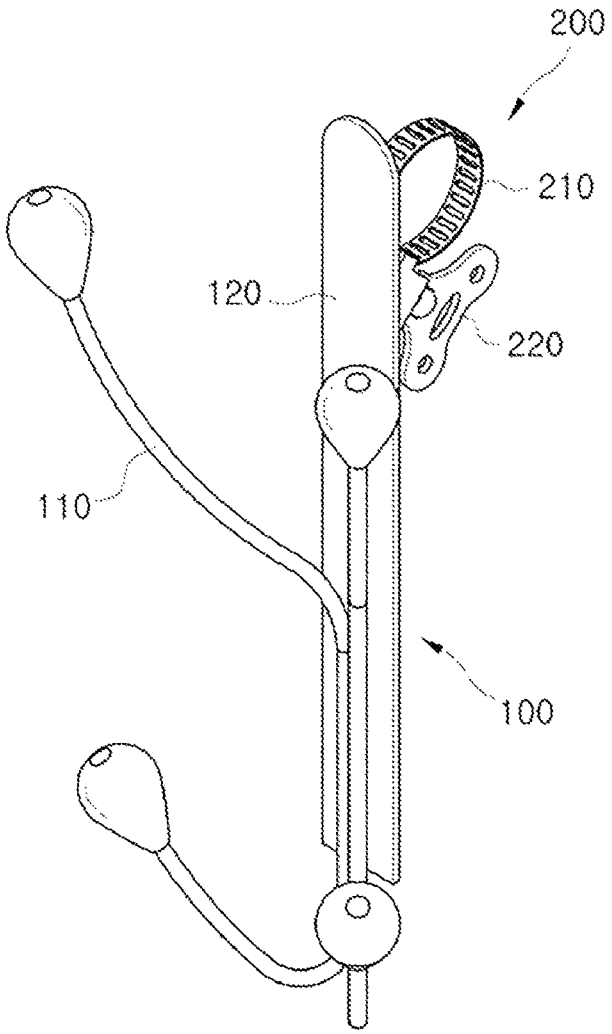

【Figure 2】
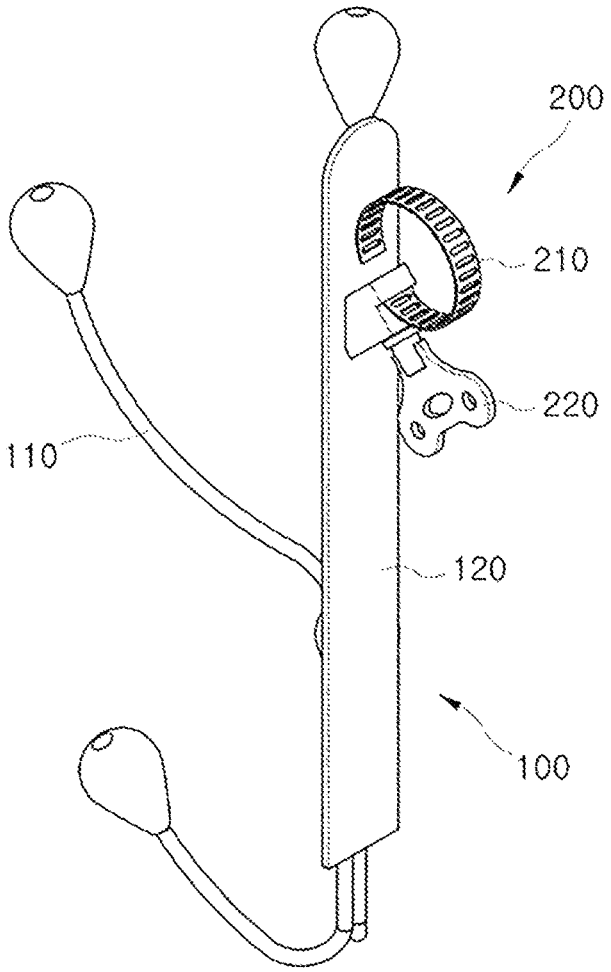

【Figure 3】
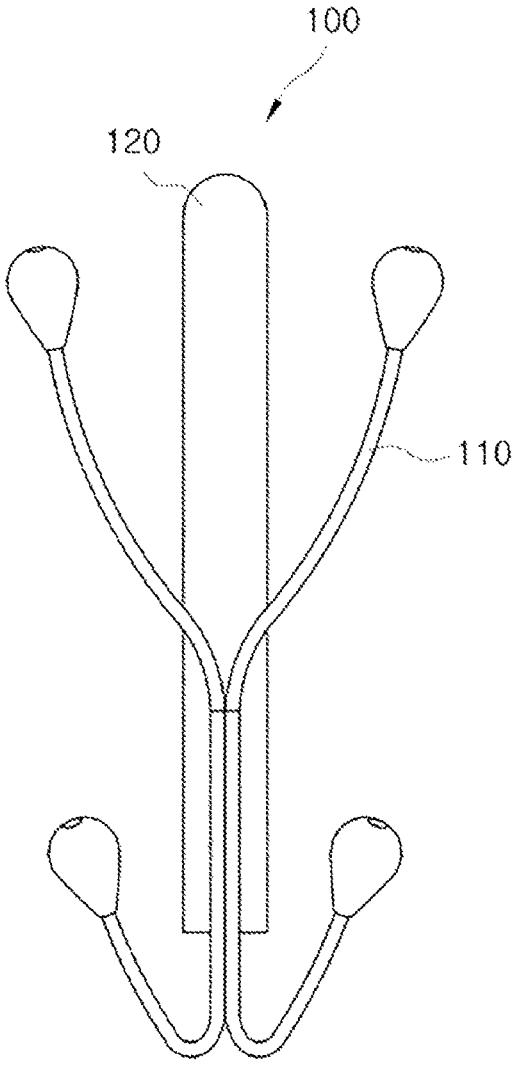

【Figure 4】
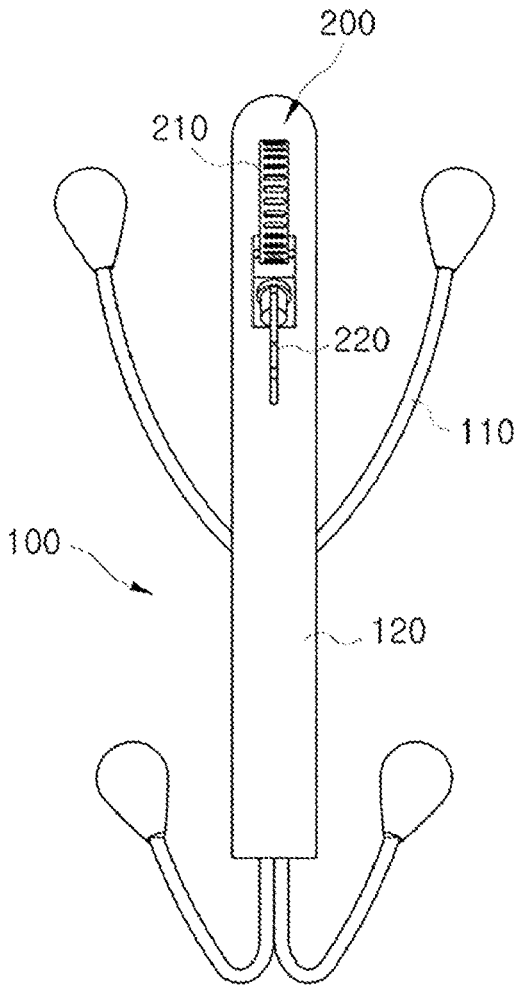

【Figure 5】
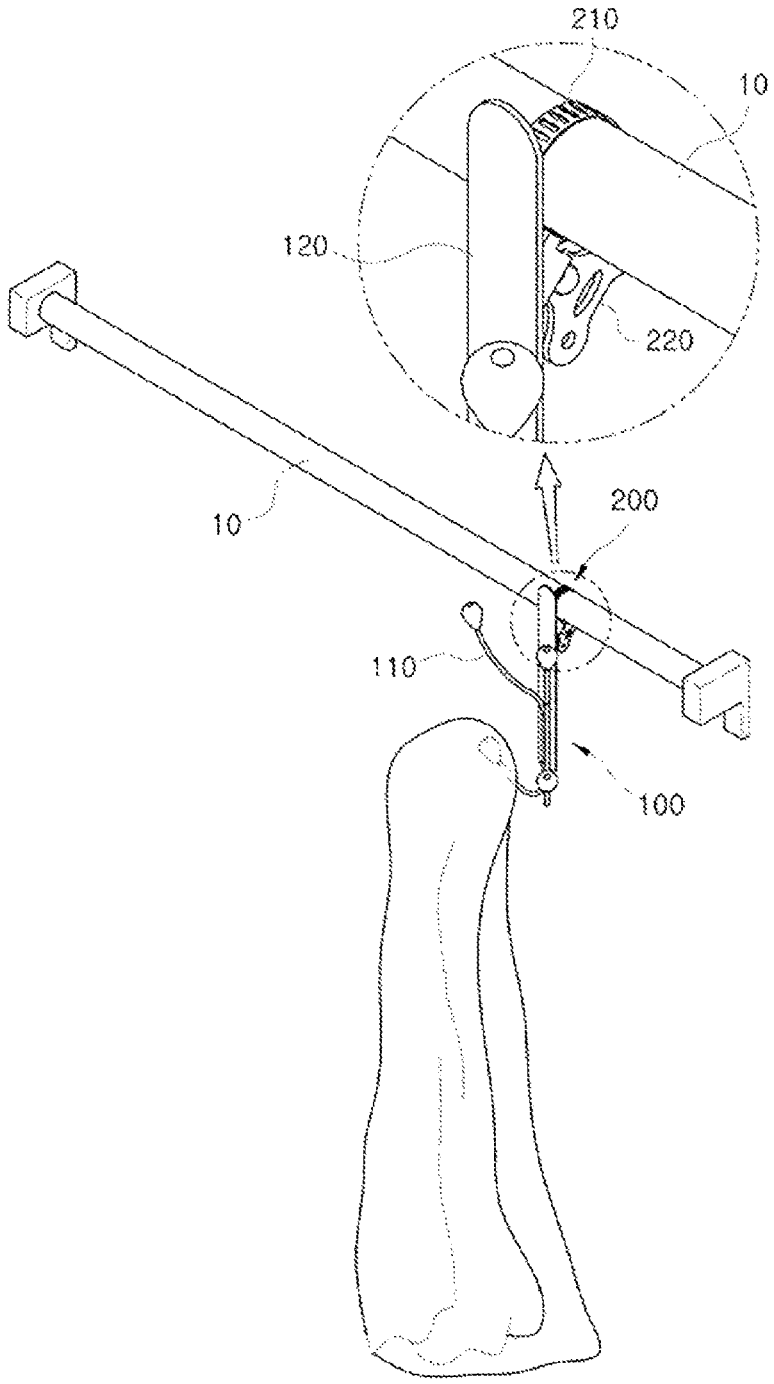

【Figure 6】
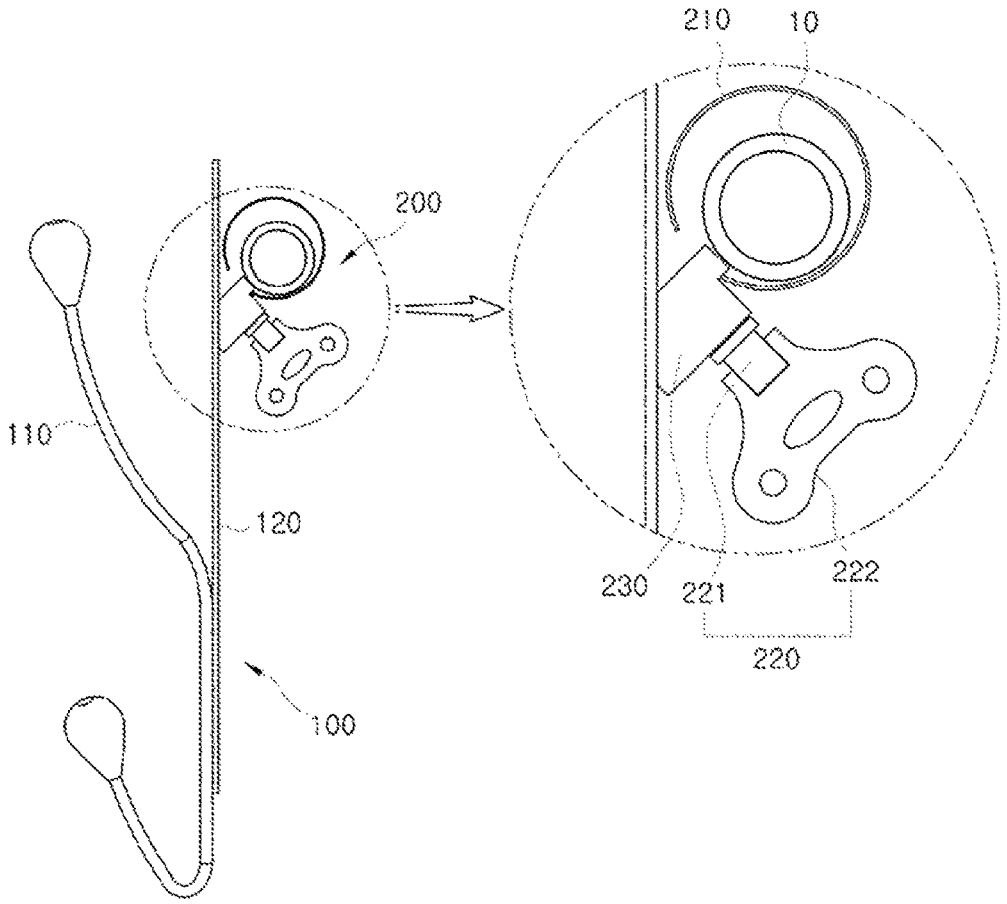

【Figure 7】
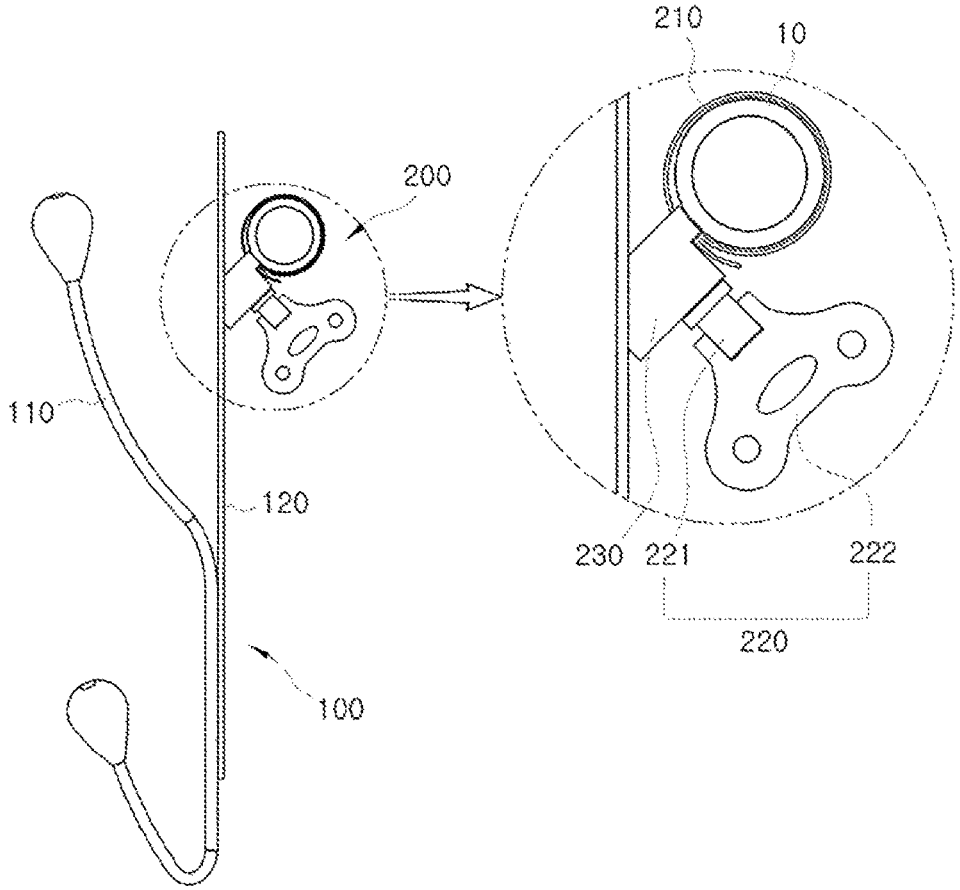

CLAMP-TYPE CLOTHES HANGER

TECHNICAL FIELD

The present invention relates to a clamp-type clothes hanger, and more particular, to a clamp-type clothes hanger capable of conveniently hanging clothes using a towel rack installed in a bathroom.

BACKGROUND ART

In general, a hanger is a tool for hanging clothes, and usually composed of a hanging frame that hangs along a shoulder line of the clothes and a ring formed in a center of the hanging frame. Since the hanging frame should be inserted so that it is located inside clothes, this type of hanger is inconvenient when used to hang clothes for a while.

In order to conveniently hang clothes for a short period of time or frequently worn clothes, a hook-type hanger composed of only a hook for hanging clothes or equipped with the hook has appeared. However, in order to install the hook-type hanger, it is necessary to drive nails into a wall or use adhesive, which has the problem of damaging a wall surface. In particular, in the case of a bathroom, the wall surface is composed of tiles, so it is difficult to drive nails in, and when an adhesive is used, moisture prevents the hook-type hanger from being attached firmly.

To solve the above problem, a hook-type hanger installed across a top of a door was developed, but a distance between a shower and a door in a bathroom is long and a height is high in terms of a shape, so there may be a case where the hook-type hanger is inconvenient to hang or pick up clothes before and after showering, and cannot be installed depending on the size or shape of the door.

DISCLOSURE

Technical Problem

The present invention is devised to solve the above problems, and an object of the present invention provides a clamp-type clothes hanger that can stay a firmly fixed without damaging a wall surface and that is convenient for hanging or picking up clothes before and after showering using a towel rack or the like installed in a bathroom.

Technical Solution

To achieve the above object, a clamp-type clothes hanger according to the present invention includes: a main body including a hook on which the clothes are hung; and a clamp which is provided on the main body, is fastened to surround a hanger rod provided away from a wall surface, and fit various diameters of the hanger rod.

In addition, the clamp may include a clamp ring that has a partially open ring shape, and a fastener that firmly fixes both ends of the clamp ring by fastening the both ends of the clamp ring in a screwing manner to fit the diameter of the hanger rod.

In addition, the fastener may be provided to be inclined upward or downward.

In addition, the main body may further include a hanger provided with the hook forward and the clamp ring located at a rear, and the clamp ring may be covered by the hanger.

In addition, the hanger may be formed in a shape of a bar having a predetermined length and width, and the clamp ring may be formed to have a width smaller than that of the hanger and is disposed to stand vertically.

In addition, the hook may be provided in plural, and ends of the hook are spaced apart from each other.

Advantageous Effects

According to the present invention, a clamp surrounds a hanger rod that may be installed in a bathroom to hang towels, etc., and is then tightened to firmly fix a main body, so that clothes may be hung on a hook provided on the main body, making it easy to hang the clothes without damaging a wall surface.

Further, since the clamp-type clothes hanger may be installed on a hanger rod located close to a bathtub, it is convenient to hang or pick up clothes before and after showering, and new underwear, old clothes, outerwear, etc., to be worn after the shower may be hung separately on multiple hooks, increasing user convenience.

BRIEF DESCRIPTION OF THE DRAWINGS

FIG. 1 is a perspective view illustrating a clamp-type clothes hanger of the present invention.

FIG. 2 is a rear perspective view illustrating the clamp-type clothes hanger of the present invention.

FIG. 3 is a front view illustrating the clamp-type clothes hanger of the present invention.

FIG. 4 is a rear view illustrating the clamp-type clothes hanger of the present invention.

FIG. 5 is an exemplary view illustrating a state in which the clamp-type clothes hanger of the present invention is installed on a hanger rod.

FIGS. 6 and 7 are exemplary views illustrating a process of installing the clamp-type clothes hanger of the present invention on the hanger rod.

BEST MODE

The present invention relates to a clamp-type clothes hanger which stays firmly fixed without damaging a wall surface, and allows a user to conveniently hang or grab clothes before and after a shower, by means of a towel rack and the like installed in a bathroom. To this end, the clamp-type clothes hanger includes: a main body comprising a hook on which clothes can be hung; and a clamp which is provided on the main body, may be fastened to surround a hanger rod provided away from a wall surface, and fit various diameters of the hanger rod.

The scope of the present invention is not limited to embodiments described below, and various modifications may be made by those skilled in the art without departing from the technical gist of the present invention.

Hereinafter, the clamp-type clothes hanger of the present invention will be described in detail with reference to the attached FIGS. 1 to 7.

As illustrated in FIGS. 1 to 7, the clamp-type clothes hanger according to the present invention includes a main body 100 and a clamp 200, and is configured to be installed in a bathroom, etc., to hang clothes using a hanger rod on which towels, etc., are hung.

The main body 100 includes a hook 110 for hanging clothes such as tops, bottoms, and underwear However, only clothes are not necessarily caught on the hook 110, but various items such as facial hair bands and shower balls may also be caught on the hook 110. In addition, the main body 100 may be provided with only one hook 110, but it is preferable to have a plurality of hooks 110 so that multiple clothes may be hung. In this case, to prevent the plurality of hooks 110 from interfering with each other, the hooks 110 are provided so that ends of the hooks 110 are spaced apart from each other at a predetermined interval or spaced apart from each other in up, down, left, and right directions.

In addition, the hook 110 may be formed in various shapes that protrude forward, and it is preferable that at least the ends of the hook 110 are provided to face upward so that clothes may be easily hung. In addition, it is preferable that the end of the hook 110 is formed larger than the remaining portion of the hook 110 or that a fixture made of a friction material is inserted to prevent the hung clothes from falling off.

The main body 100 may further include a hanger 120 in which the hook 110 is provided forward. The hanger 120 may be formed in various shapes. For example, as illustrated in FIGS. 1 to 7, the hanger 120 may be formed in a bar shape with a predetermined length and width, and the plurality of hooks 110 may be provided on a front surface of the hanger 120 formed in a bar shape so that ends of the hooks 110 are spaced apart from each other in the up, down, left and right directions.

Meanwhile, as illustrated in FIGS. 1 to 7, the clamp 200 is provided in the main body 100, and is fastened to surround a hanger rod 10 and fit a diameter of the hanger rod 10. In this case, the hanger rod 10 is installed as a whole while being spaced apart from a wall surface of a bathroom, etc., and the clamp 200 may include a clamp ring 210 and a fastener 220.

The clamp ring 210 may have a partially open circular ring shape or a partially open polygonal ring shape, and a shape of the clamp ring 210 may vary depending on a cross section of the hanger rod 10. However, considering that the hanger rod 10 usually has a circular cross section, the following description will be made on the assumption that the clamp ring 210 is in the form of a partially open circular ring as illustrated in FIGS. 2 and 6. In addition, it is preferable that the clamp ring 210 is made of an elastic material so that the fastened state may be firmly maintained when fastened by the fastener 220.

The clamp ring 210 is preferably provided to stand vertically so as to surround the hanger rod 10 which is generally provided horizontally and spaced apart from the wall surface, and may be provided at a lower portion of the hanger 120, but is preferably provided at an upper portion of the hanger 120 for stable fixation. In addition, since the clamp ring 210 is provided at the upper portion of the hanger 120, the clamp ring 210 may be provided at an upper end of the hanger 120, but the clamp ring 210 is exposed to the outside and becomes unattractive, so the clamp ring 210 is preferably provided on an upper rear surface of the hanger 120. In this case, the clamp ring 210 having a width smaller than that of the hanger 120 may be provided to stand vertically on the upper rear surface of the hanger 120. As illustrated in FIG. 3, when viewed from the front, the clamp ring 210 is covered by the hanger 120, allowing the user to feel its beauty.

The fastener 220 may fasten both ends of the open clamp ring 210 to fit the diameter of the hanger rod 10. For example, as illustrated in FIGS. 6 and 7, the fastener 220 may include a fastening screw part 221 that connects between the open ends of the clamp ring 210 and a handle part 222 that is formed at the end of the fastening screw part 221 that allows a user to grip and rotate the fastening screw part 221.

In addition, as illustrated in FIGS. 6 and 7, the clamp 200 may further include a connecting member 230 that has one end of the clamp ring 210 fixed thereto, has the fastening screw part 221 fastened adjacent to the clamp ring 210, and is fixed to a rear surface of the hanger 120. The connecting member 230 has a circular ring shape, making it difficult for the elastically variable clamp ring 210 to be directly fixed to the rear surface of the hanger 120, and is to compensate for the weakening of the bonding strength even if the elastically variable clamp ring 210 is fixed.

In this case, a screw thread may be formed on an outer peripheral surface of the fastening screw part 221, and fixing holes that may accommodate one point of the screw thread may be formed through the outer peripheral surface of the clamp ring 210 at regular intervals. Therefore, as illustrated in FIG. 6, after the partially open clamp ring 210 surrounds the hanger rod 10, one end of the clamp ring 210 that is not fixed to the connecting member 230 is pushed into the connecting member 230 to fit the diameter of the hanger rod 10, and as the handle part 222 is rotated, a screw thread of the fastening screw part 221 is caught on one of the plurality of fixing holes formed in the clamp ring 210, so as illustrated in FIG. 7, the main body 100 is fixed to the hanger rod 10 by the clamp 200.

However, as described above, the clamp ring 210 and the fastener 220 do not necessarily need to be linked through the connecting member 230, and the clamp 200 may be configured in a structure where the fastening screw part 221 is directly connected to both ends of the clamp ring 210.

In this case, the screw thread may be formed on the outer peripheral surface of the fastening screw part 221, and at least one end of the clamp ring 210 may move along the screw thread of the fastening screw part 221. Therefore, after releasing the fastening screw part 221 fastened to the clamp ring 210, the clamp ring 210 with open both ends surrounds the hanger rod 10, and then the fastening screw part 221 is connected to both ends of the clamp ring 210. Thereafter, by rotating the handle part 222, the clamp ring 210 may be fastened to fit the diameter of the hanger rod 10.

The fastener 220 may be disposed horizontally from the rear to the front, but is not easy to operate due to interference between the hanger rod 10 and the wall surface on which the hanger rod 10 is installed while gripping and rotating the handle part 222, and therefore, as illustrated in FIGS. 5 to 7, the fastener 220 is preferably provided to be inclined upward or downward from the rear to the front.

A user may easily grip and rotate the handle part 222 of the inclined fastener 220 at the lower or upper side of the hanger rod 10, so the clamp 200 may be more easily fastened to fit various diameters of the hanger rod 10.

As described above, the clamp-type clothes hanger of the present invention stays firmly fixed without damaging the wall surface since the clamp 200 surrounds the hanger rod 10 which is installed in a bathroom, etc., to hang towels, etc., and then is fastened to firmly fix the main body 100. In addition, since the clamp-type clothes hanger of the present invention can be installed on the hanger rod 10 located close to a bathtub, user convenience is increased by making it convenient to hang or pick up clothes separately before and after showering.

SEQUENCE LIST FREE TEXT

Description of Reference Signs

10: Hanger rod
100: Main body 110: Hook

120: Hanger
200: Clamp 210: Clamp ring
220: Fastener 221: Fastening screw part
222: Handle part 230: connecting member

The invention claimed is:

1. A clamp-type clothes hanger, comprising:

a main body (100) including a hook (110) on which the clothes are hung; and a clamp (200) which is provided on the main body (100), is fastened to surround a hanger rod (10) provided away from a wall surface, and may fit various diameters of the hanger rod (10), wherein the clamp (200) comprises a clamp ring (210) that has a partially open ring shape, and a fastener (220) that firmly fixes both ends of the clamp ring (210) by fastening the both ends of the clamp ring (210) in a screwing manner to fit the diameter of the hanger rod (10).

2. The clamp-type clothes hanger of claim 1, wherein the fastener (220) is provided to be inclined upward or downward.

3. The clamp-type clothes hanger of claim 1, wherein the main body (100) further comprises a hanger (120) provided with the hook (110) forward and the clamp ring (210) located at a rear, and the clamp ring (210) is covered by the hanger (120).

4. The clamp-type clothes hanger of claim 3, wherein the hanger (120) is formed in a shape of a bar having a predetermined length and width, and the clamp ring (210) is formed to have a width smaller than that of the hanger (120) and is disposed to stand vertically.

5. The clamp-type clothes hanger of claim 1, wherein the hook (110) is provided in plural, and ends of the hook (110) are spaced apart from each other.

* * * * *